United States Patent [19]

Wirz et al.

[11] Patent Number: 4,940,221

[45] Date of Patent: Jul. 10, 1990

[54] SUCTION-TYPE SHEET-SEPARATING DEVICE FOR A FEEDER OF A PRINTING PRESS

[75] Inventors: Arno Wirz, Bammental; Detlev Krause, Hockenheim, both of Fed. Rep. of Germany

[73] Assignee: Heidelberger Druckmaschinen AG, Heidelberg, Fed. Rep. of Germany

[21] Appl. No.: 289,605

[22] Filed: Dec. 23, 1988

[30] Foreign Application Priority Data

Dec. 23, 1987 [DE] Fed. Rep. of Germany ..... 3743805

[51] Int. Cl.[5] ..... B65H 3/08

[52] U.S. Cl. ..... 271/107; 271/108; 271/31; 414/797; 294/64.1; 73/37.7; 33/552; 101/232

[58] Field of Search ..... 271/20, 90, 91, 92, 271/93, 97, 98, 103, 104, 105, 106, 107, 108, 265, 267, 31, 148; 414/797; 294/64.1; 221/211; 73/37.7; 33/551, 552; 101/232

[56] References Cited

U.S. PATENT DOCUMENTS

| | | | |
|---|---|---|---|
| 2,689,730 | 9/1954 | Tebbs | 271/107 |
| 3,194,055 | 7/1965 | Knobel | 73/37.7 X |
| 3,937,457 | 2/1976 | Schwebel | 271/92 |
| 3,938,800 | 2/1976 | Wirz . | |
| 4,458,891 | 7/1984 | Kawaguchi | 271/93 |

FOREIGN PATENT DOCUMENTS

| | | | |
|---|---|---|---|
| 822896 | 3/1952 | Fed. Rep. of Germany . | |
| 1929714 | 10/1970 | Fed. Rep. of Germany . | |
| 2309012 | 7/1975 | Fed. Rep. of Germany . | |
| 3609549 | 10/1987 | Fed. Rep. of Germany . | |
| 0063634 | 4/1983 | Japan | 271/98 |
| 0221308 | 7/1968 | U.S.S.R. | 33/552 |
| 582078 | 11/1946 | United Kingdom | 271/90 |
| 1547776 | 6/1979 | United Kingdom | 271/98 |

*Primary Examiner*—Joseph J. Rolla
*Assistant Examiner*—David H. Bollinger
*Attorney, Agent, or Firm*—Herbert L. Lerner; Laurence A. Greenberg

[57] ABSTRACT

A suction-type sheet-separating device for a feeder of a printing press has suction-type grippers for lifting off an uppermost sheet from a pile of sheets and for transferring the lifted-off sheet to a transporting device for conveying the lifted-off sheet in a sheet travel direction towards a printing unit of the printing press. The suction-type grippers are disposed above the pile of sheets in the vicinity of the trailing edge of each sheet and when suction air is applied thereto, they initially grip the uppermost sheet and then execute a prestroke to a first height. The device includes a lifting gear drive and a horizontal carrying shaft parallel to the trailing edge of the sheet and carrying the suction-type grippers, the suction-type grippers being aligned with respect to the carrying shaft. The lifting gear drive serves, on an upward stroke and a downward stroke in phase with the printing press, to raise and lower the carrying shaft on a substantially straight, vertical path in a manner that, on an upward stroke, the suction-type grippers are raised to a second height located above the first height. The carrying shaft is held in the lifting gear drive so that it is able to swivel about its own longitudinal axis and is rotationally rigidly connected, so as to be rigid against relative rotation, to a link for a swivelling device for selective swivel positions. The link is guidable substantially parallel to itself in the selectable swivel positions.

15 Claims, 6 Drawing Sheets

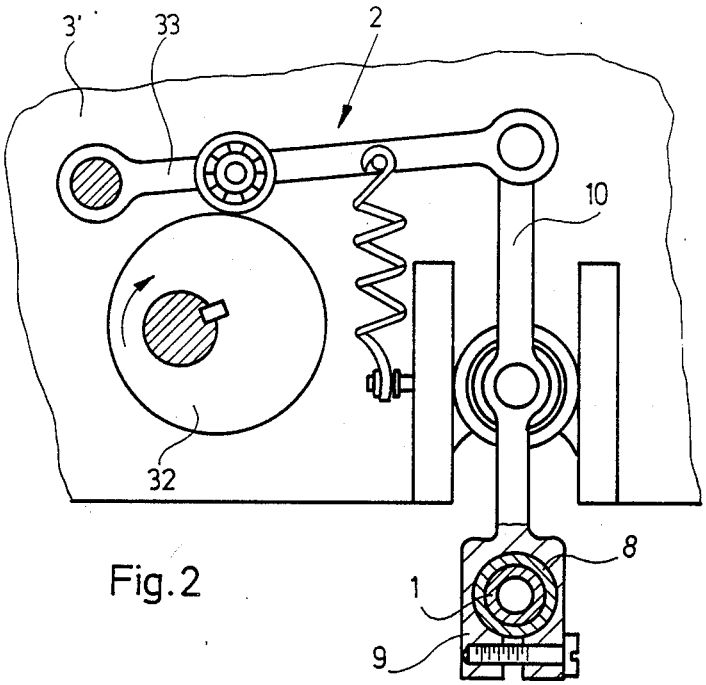
Fig. 2
Fig. 3
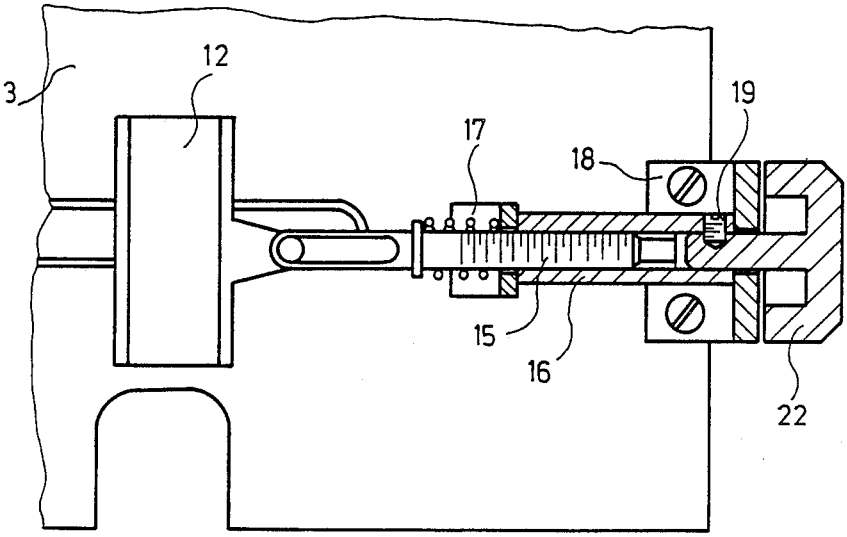

SUCTION-TYPE SHEET-SEPARATING DEVICE FOR A FEEDER OF A PRINTING PRESS

The invention relates to a suction-type sheet separating device for a feeder of a printing press, with suction-type grippers for lifting off the uppermost sheet from a pile of sheets and for transferring the lifted-off sheet to transporting means for conveying the lifted-off sheet in a sheet travel direction towards a printing unit of the printing press, the suction-type grippers being disposed above the pile of sheets in the vicinity of the trailing edge of each sheet and when having suction air applied thereto, initially gripping the uppermost sheet and then executing a prestroke to a first height, as well as a lifting gear drive and a horizontal carrying shaft parallel to the trailing edge of the sheet and carrying the suction-type grippers, the suction-type grippers being aligned with respect to the carrying shaft, the lifting gear drive serving, on an upward stroke and a downward stroke in phase with the printing press, to raise and lower the carrying shaft on a basically straight, vertical path in a manner that, on an upward stroke, the suction-type grippers are raised to a second height.

Such a device has become known, for example, from German Published Prosecuted Application (DE-AS) No. 19 29 714. Suction-type grippers are described therein as being clamped upon a carrying shaft, in particular, in such a manner that they can be swivelled in a sheet travel direction and opposite thereto. This adjustment possibility, according to the state of the art, allows for the fact that the surface of the pile of sheets may deviate at its edges from a horizontal plane and may be convex or concave in a direction perpendicular to that plane, the trailing sheet edge being lower, in the case of convex curvature, and higher, in the case of concave curvature, than the regions of the pile surface located towards the middle of the sheet. Pile edges of the afore-described convex form occur, for example, if printed sheets with non-printed margins have been stacked in great quantity. In order to separate the sheets from such a pile in the feeder of a printing press with the heretofore known device, the clamping of the suction-type grippers is released and, with the suction-type grippers in a swivel position adapted to the curvature of the pile surface, their connection to the carrying shaft so as to prevent relative rotation is re-established. This is intended to ensure that sheets, particularly those of a relatively high weight per unit area, can be separated without trouble from a pile of the afore-described form. If the inclination of the suction-type grippers is not adapted to the surface of the pile, such trouble may occur due to the fact that the sheets may not be reliably gripped by the suction-type grippers.

With the heretofore known device, the releasing and reestablishing of the clamped connection between the suction-type grippers and the carrying shaft that carries them can be accomplished only when the machine is at rest, because the carrying shaft is incorporated into the lifting gear drive which operates in phase with the machine.

Heretofore known from German Published Non-Prosecuted Application (DE-OS) No. 36 09 549 is a suction-type sheet-separating apparatus having suction-type grippers which can be swivelled also during the operation of the printing press in order to adapt their position to the curvature of the edges or borders of the pile.

This heretofore known device has guides that can be swivelled about a fixed horizontal carrying shaft in and opposite to the sheet travel direction, with the suction-type grippers, after they have gripped the uppermost sheet, executing in the guides an upward stroke that follows the respective swivel direction of the guides. The stroke distance that is to be covered depends, in particular, on the size and weight per unit area of the sheets that are to be lifted off the pile. Large-size sheets of high weight per unit area require a correspondingly longer stroke distance than smaller-size sheets of lower weight per unit area. In the case of correspondingly long stroke distances, with the guides inclined in or opposite to the sheet travel direction and with the sheets having been gripped by the suction-type grippers, the gripped region of the respective sheet is transported in or opposite to the sheet travel direction even while it is being lifted off, i.e., before transfer thereof to drag suckers.

After a sheet has been lifted off, in the vicinity of its trailing edge, from the sheet below it in the pile, the sheet is able, with its regions still resting on the sheet below it, to exert on the sheet below it a shear force acting in the sheet travel direction as the lifted-off sheet is transported in the sheet travel direction with the aid of the drag suckers. This shear force may mean, under certain circumstances, that the sheet lying under the uppermost sheet is likewise, but unintentionally, transported in the sheet travel direction and is thus fed in an undesired manner to the printing press.

This is counteracted in heretofore known feeders, among other things, by providing stops on the side of the pile of sheets facing towards the printing press, the stops projecting beyond the uppermost sheet, being disposed on a so-called tilting shaft and being adapted to be tilted away by means of the latter towards the printing press. In this connection, the control of the tilting shaft is carefully coordinated with the movement of the drag suckers.

As the uppermost sheet is being lifted off by means of the suction-type grippers and prior to its transfer to the drag suckers, it may be moved by the suction-type grippers in the sheet travel direction. The uppermost sheet will then bulge up in the region of its leading edge as it comes up against the stops of the tilting shaft which have not yet been tilted away. As the sheet is further transported by the drag suckers, it may therefore fold over in a downward direction, with the result that the following parts of the sheet will then tumble over, causing a disruption in the sheet transport.

Such trouble may result, in particular, from the fact that the suction-type grippers are held in inclined guides, the inclination of which imparts a movement which is not insignificant in the sheet travel direction to the uppermost sheet while it is being lifted off.

It is accordingly an object of the invention to provide a universally applicable suction-type sheet-separation device, in which, with the suction-type grippers inclined in or opposite to the sheet travel direction, the device does not exert any disturbing influence on the transport of the uppermost sheet in the sheet travel direction after the sheet has been lifted off the pile and in which the inclination of the suction-type grippers can be changed with the printing press in operation and without any major effort on the part of the operator.

With the foregoing and other objects in view, there is provided, in accordance with the invention a suction-type sheet-separating device for a feeder of a printing press with suction-type grippers for lifting off an uppermost sheet from a pile of sheets and for transferring the lifted-off sheet to transporting means for conveying the lifted-off sheet in a sheet travel direction towards a printing unit of the printing press. The suction-type grippers are disposed above the pile of sheets in the vicinity of the trailing edge of each sheet and when suction air is applied thereto, they initially grip the uppermost sheet and then execute a prestroke to a first height. The device comprises a lifting gear drive and a horizontal carrying shaft parallel to the trailing edge of the sheet and carrying the suction-type grippers, the suction-type grippers being aligned with respect to the carrying shaft. The lifting gear drive serves, on an upward stroke and a downward stroke in phase with the printing press, to raise and lower the carrying shaft on a substantially straight, vertical path in a manner that, on an upward stroke, the suction-type grippers are raised to a second height located above the first height. The carrying shaft is held in the lifting gear drive so that it is able to swivel about its own longitudinal axis and is connected, so as to be rigid against relative rotation, to a link for a swivelling device for selective swivel positions. The link is guidable substantially parallel to itself in the selectable swivel positions.

The lifting gear drive permits the use of suction-type grippers in the form of so-called lift-type suckers, which in general, have a shorter prestroke than so-called fall-type suckers. This is especially desirable in the handling of so-called through-sucking papers because, if use were made of fall-type suckers with generally longer prestrokes, there would otherwise be a danger that sheets lying under the uppermost sheet would be lifted off together with he uppermost sheet by the suction-type grippers. This would cause disruptions in the transport of the sheets.

If suction-type grippers in the form of lift-type suckers are used, when the suction-type grippers are inclined in the sheet travel direction or opposite to the sheet travel direction, their short prestroke reduces the danger of the uppermost sheet folding over at the stops of the tilting shaft. This danger is reduced because the transport of the sheet, e.g., in the sheet travel direction, which is caused by this short prestroke results in only a very small movement of the sheet towards the tilting shaft.

As the sheet is further lifted to the second height, by means of the lifting gear drive, there is likewise no shifting of the sheet which might have an adverse effect on the transport of the sheet. This is because the carrying shaft with the suction-type grippers, which are aligned with respect to the carrying shaft, is raised on a substantially straight, vertical path by the lifting gear drive during the upward stroke of the latter.

As more of the uppermost sheets are removed from a pile of the previously described form with a curved surface in the trailing edge region of the pile, it may be observed that the curvature of the pile edge flattens off more and more. To correctly grip the uppermost sheet, therefore, it is necessary constantly to match the inclination of the suction-type grippers in or opposite to the sheet direction, to the changing curvature. With the suction-type gripper apparatus according to the invention, this matching process is performed while the printing press is in operation, although the carrying shaft carrying the suction-type grippers is raised and lowered in phase with the printing press without interruption. This requires merely a change in the swivel position of the link of the swivelling device, that link being guided basically parallel to itself.

In accordance with another feature of the invention, the swivelling device is formed of the link, a vertical first straight guide for one end of the link facing away from the carrying shaft, a second straight guide for the first straight guide disposed parallel to the sheet-travel direction, and adjusting means by which the first straight guide is displaceable on the second straight guide both in and opposite to the sheet travel direction.

With a swivelling device of this general type, parallel guidance of the link in selective swivel positions is accomplished with simple structural elements and is reduced to a mere horizontal displacement of a vertical straight guide. This permits a similarly simple construction of the adjusting means, which, in accordance with a further feature of the invention comprises an adjusting spindle articulatingly connected to the second straight guide, and an axially clamped spindle nut cooperating with the adjusting spindle.

In accordance with an added feature of the invention, the vertical first straight guide is formed with two spaced-apart guide surfaces perpendicular to the sheet travel direction and a roller guided between the guide surfaces, the roller being held on the end of the link facing away from the carrying shaft so that it is freely rotatable about a roller shaft disposed parallel to the carrying shaft. Such means for parallel guidance of the link in its selective swivel positions have a wear-reducing effect on the swivelling device and also prevent any possible tilting of the link during its stroke movements.

In accordance with an additional feature of the invention the spindle nut is connected to a turning knob so as to be fixed against relative rotation therewith. By turning this knob in one of the two directions of rotation of the spindle nut, it is possible readily to match the inclination of the suction-type grippers to the particular requirements.

The effort required on the part of the operator in order to achieve this matching can be further reduced in accordance with again another feature of the invention which includes automatic reversible driving means, the spindle nut being rotationally connected to the automatic reversible driving means.

In accordance with again a further feature of the invention manually operated switching means are provided for selecting a direction of rotation and a rotational speed of the spindle nut, the reversible driving means being connected to the switching means In this connection, the switching means are preferably provided with labels indicating the direction of inclination of the suction-type grippers.

The constantly necessary matching of the inclination of the suction-type grippers can be simplified in accordance with yet another feature of the invention which includes a scanning device having at least one first sensor and at least one second sensor for scanning a curved surface of a border region of the pile of sheets associated with the trailing sheet edge at least at one first and one second measuring location. The measuring locations are disposed behind one another in the sheet travel direction, and the reversible driving means are activatable by the scanning device as a function of a difference in height between the first and the second measuring location. For this purpose, sensors in the form of inductive distance indicators are used.

This relieves the operator of the task of always having to keep an eye on the curvature of the pile edge under the suction-type grippers, which constantly changes as the height of the pile decreases, and of having continually to match the inclination of the suction-type grippers to this curvature.

In accordance with yet a further feature of the invention the sensors are contactless sensors. This makes it possible, in particular, to dispose conventional contactless sensors, such as reflected-light sensors or dynamic-pressure jets, opposite a side face of the pile of sheets, the side face being formed of edges of the sheets forming the pile of sheets and extending in the sheet travel direction. Such an arrangement of the sensors has the advantage that the lifting-off of the uppermost sheet is not hindered by the scanning device. A scanning device disposed directly above the pile of sheets would, on the other hand, have to be swung away, at least occasionally, to the side of the pile of sheets in order not to impede the lifting-off of the uppermost sheet.

In accordance with yet an added feature of the invention measured in the sheet travel direction, the first sensor and the second sensor are disposed at a mutually spaced distance, that distance being the distance between the measuring locations, at least one of the sensors being vertically adjustable with respect to the other sensor.

Since it is customary, during printing, for the pile of sheets to be so adjusted that the top of the pile remains at approximately the same height, the equipping of the scanning device with one fixed sensor and one vertically adjustable sensor makes it possible to reduce the level of sophistication required for the scanning device.

In accordance with yet an additional feature of the invention the one of the sensors is rigidly disposed in the scanning device and is adjustable to a selective working height by means of an adjusting device for the scanning device. This produces the advantage that a relatively simple adjusting device is merely required in order to match the scanning device to major profile changes in the curvature of the surface of the pile of sheets or to a different initial height after the pile of sheets has been changed.

If the piles of sheets being used are basically of identical initial height, particular advantage can be derived from still another feature of the invention wherein the first sensor and the second sensor are each vertically adjustable with respect to one another.

Adaptation to different sizes of sheet is accomplished in accordance with still a further feature of the invention wherein the scanning device is horizontally movable.

In accordance with a concomitant feature of the invention, a lifting gear drive for guiding the carrying shaft on a straight path at least during the upward stroke thereof.

Other features which are considered as characteristic for the invention are set forth in the appended claims.

Although the invention is illustrated and described herein as embodied in a suction-type sheet-separating device for a feeder of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 2 is a fragmentary elevational view, partly in section, of FIG. 1, showing how a carrying shaft is held in a lifting gear drive in a manner that it is able to swivel about its own longitudinal axis;

FIG. 3 is another fragmentary elevational view, partly in section, of FIG. 1, showing manually operated adjusting means for horizontally displacing a vertical straight guide;

Figure 5:
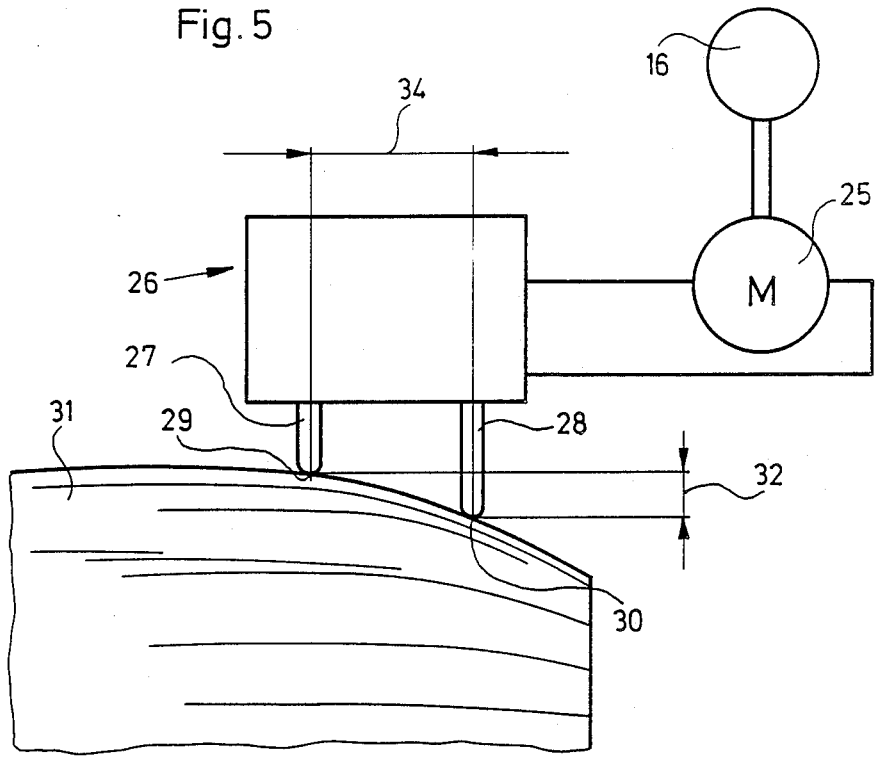
FIG. 5 is a diagrammatic, simplified elevational view of a scanning device for scanning the curvature of the surface of a pile of sheets, the scanning device, in turn, activating a geared motor as shown in FIG. 4 having a spindle nut fixed against rotation connected thereto.
Figure 4:
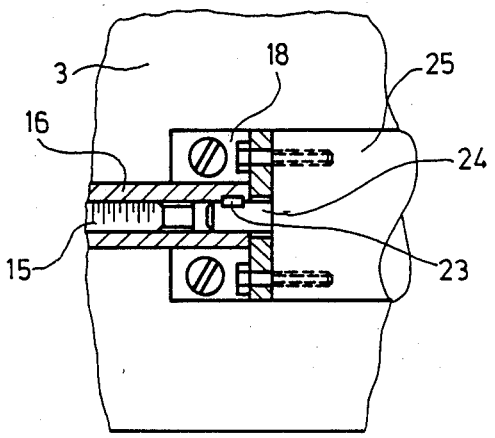
FIG. 4 is a fragmentary view of FIG. 3 showing a rotary connection between a spindle nut of the adjusting means of FIG. 3 and an automatic reversible driving means in the form of a geared motor.
Figure 5A:
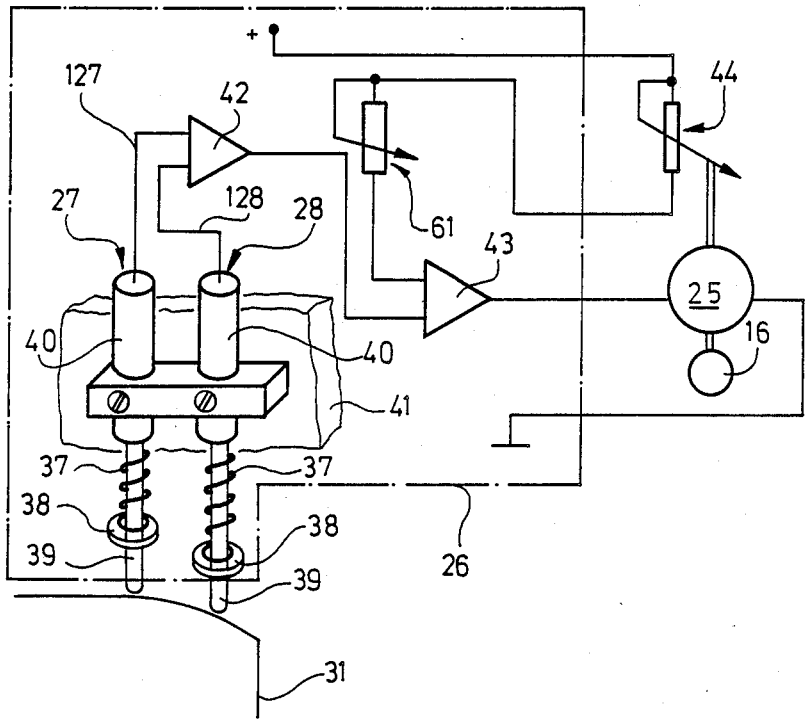
Figure 6:
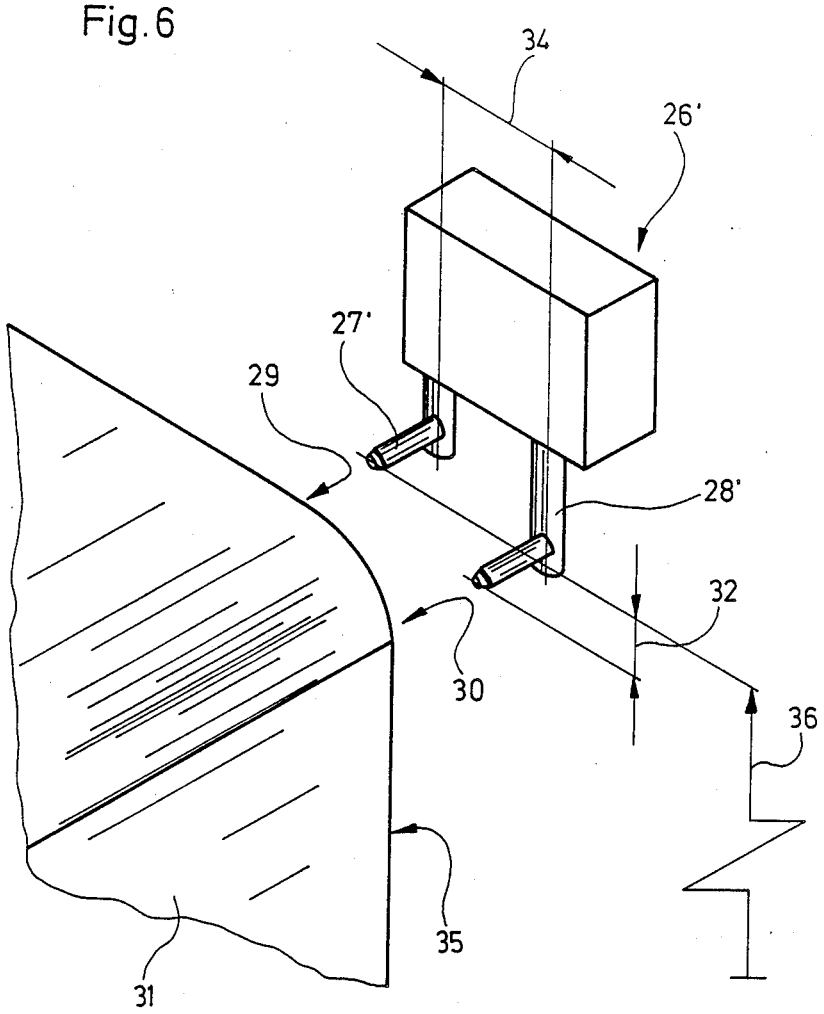
Figure 6A:
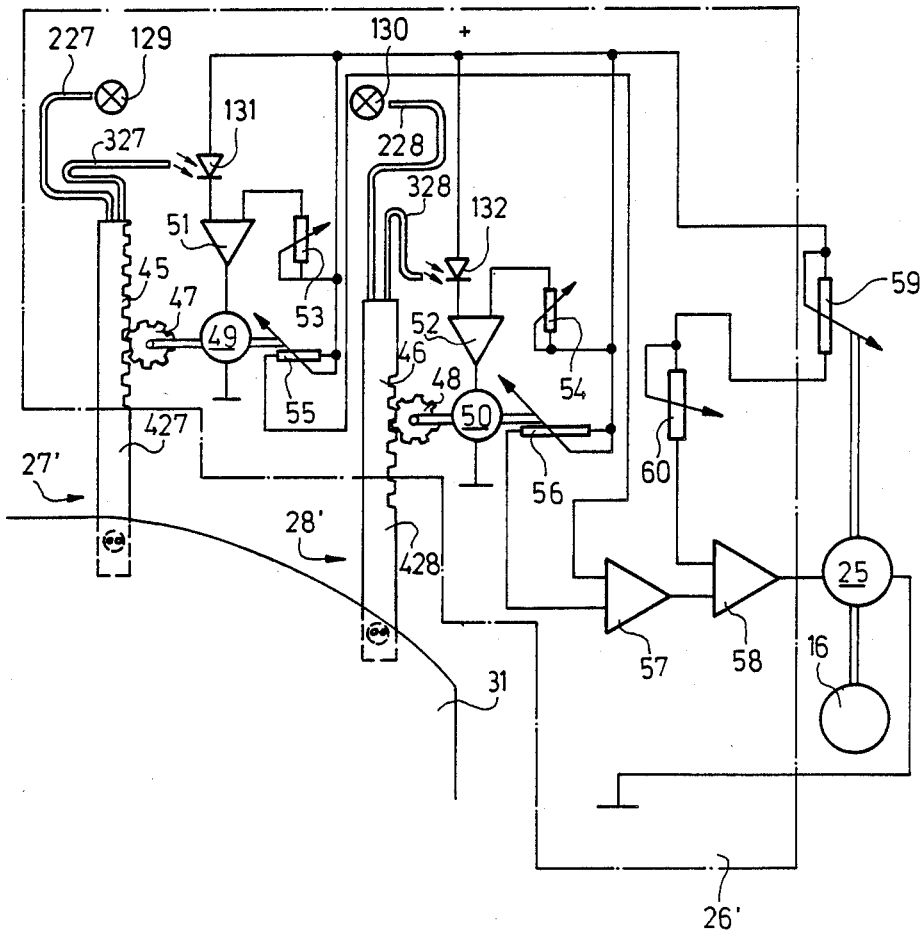

FIG. 5*a* is a diagrammatic view, partly schematic, of a scanning device according to FIG. 5;

FIG. 6 is a diagrammatic simplified perspective view of a scanning device with contactless sensors;

FIG. 6*a* is a diagrammatic view, partly schematic, of the scanning device activating a geared motor as shown in FIG. 4 with a spindle nut fixed against rotation connected thereto.

In the drawing, like components are identified by the same reference numbers.

Figure 1:
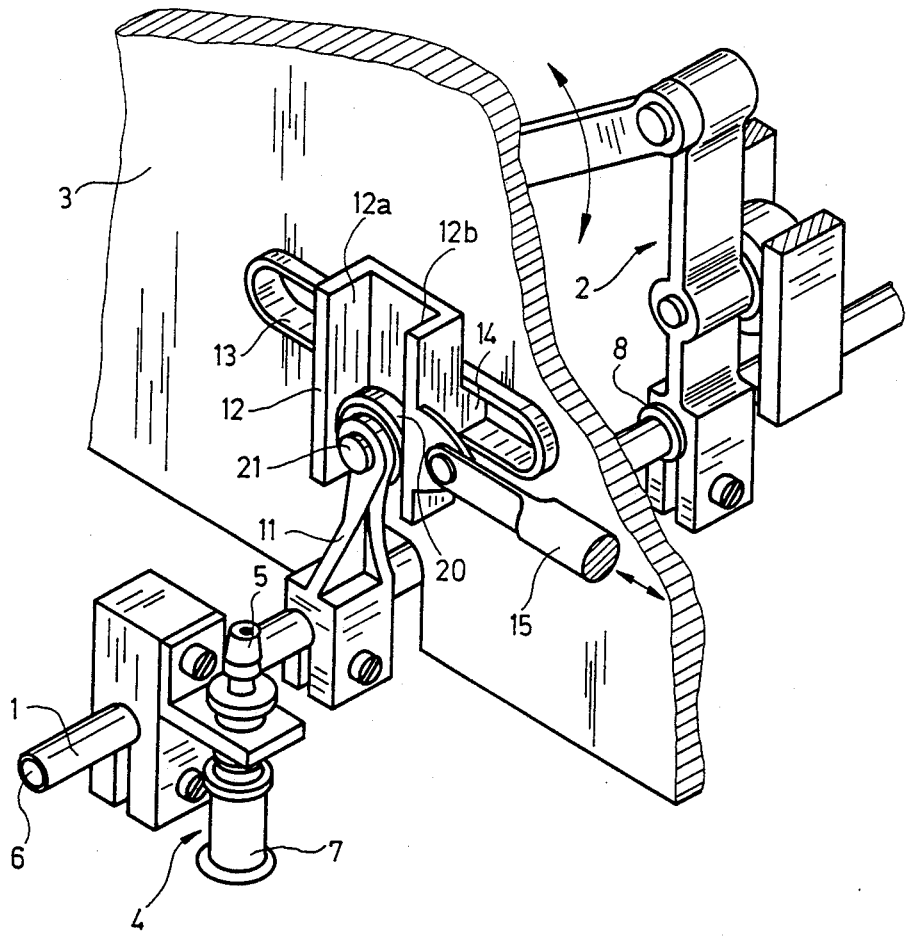
FIG. 1 is a simplified fragmentary perspective view of a suction-type gripper device according to the invention, in which adjusting means of a swivelling device are indicated by a partly broken-away or truncated adjusting spindle.

Referring now to the drawing and first, particularly, to FIG. 1 thereof, there is shown therein a carrying shaft 1 held in a lifting gear drive 2 in a manner that it is able to swivel about its own longitudinal axis. The lifting gear drive 2 corresponds to a conventional construction (German Published Prosecuted Application No. 19 29 714) of a suction head, of which part of a side wall 3 is shown in FIG. 1. As in the foregoing conventional construction, both ends of the carrying shaft 1 are equipped with suction-type grippers 4, the suction-type grippers 4 are aligned with respect to the carrying shaft 1, and connecting nipples 5 of the suction-type grippers 4 are connected via a non-illustrated flexible tube to an interior space 6 of the carrying shaft 1, which is in the form of a tube, with the interior of which, in turn, connected to a non-illustrated controllable vacuum source.

When the non-illustrated vacuum source becomes effective at the suction-type gripper 4, a suction base 7 thereof, together with a sheet vacuum-gripped by the latter, is raised to a first height. The lifting gear drive 2, which operates in phase with the printing press, then executes an upward stroke to raise the suction base 7 by means of the carrying shaft 1, which is held in the lifting gear drive 2, on a basically straight vertical path to a second height situated above the first height.

In order for the carrying shaft 1 to be held in the lifting gear drive 2 in a manner that it is able to swivel about its own longitudinal axis, the carrying shaft 1, as shown in FIG. 2, is held in a swivelling manner in a sleeve 8, which, in turn, is connected by a clamped connection to the lower end 9 of a vertically disposed lifting rod 10 of the lifting gear drive 2, which is disposed between the side walls 3 and 3' of the suction head.

As shown in FIG. 1, a link 11 is connected at one of its ends to the carrying shaft 1 so as to be fixed against relative rotation and, at an end thereof facing away from the carrying shaft 1, it is guided on a horizontal straight guide 13. The horizontal straight guide 13 is disposed so that it guides the vertical straight guide 12 parallel to the sheet travel direction. With the vertical straight guide 12 in a defined position with respect to the horizontal straight guide 13, the link 11 remains basically parallel to itself, irrespective of the instantaneous height of the carrying shaft 1, which is raised and lowered by the lifting gear drive, during the stroke movements imparted to the link 11 by the carrying shaft 1. Accordingly, the suction-type gripper is raised and lowered at a selective inclination respectively in and opposite to the sheet travel direction and without any prejudicial effect upon the transport of the sheet caused by a directional component respectively in and opposite to the sheet travel direction.

The inclination of the suction-type grippers is capable of being selected by displacing the vertical straight guide 12 in relation to the horizontal straight guide 13. Such displacement is also possible during the stroke movements of the lifting gear drive 2, i.e., while the printing press is in operation.

To guide the vertical straight guide 12 on the horizontal straight guide 13, in the embodiment of FIG. 1, a lug 14 of the vertical straight guide 12 engages a horizontal slit in the side wall 3. The lug 14 is prevented by non-illustrated locking means from dropping out of the slit formed in the horizontal straight guide 13. To displace the vertical straight guide 12, an adjusting spindle 15 is linked or articulatingly connected to the latter.

The swivelling of the link 11 and of its guide at its end facing away from the carrying shaft 1 is accomplished by parallel guide surfaces 2*a* and 12*b* of the vertical straight guide 12, between which there is guided a roller 20 which is held on the end of the link 11 facing away from the carrying shaft 1 so that it is freely rotatable about a roller shaft 21 parallel to the carrying shaft 1.

As shown in FIG. 3, the adjusting spindle 15 cooperates with a spindle nut 16, which is axially clamped between two brackets 17 and 18 attached to the side wall 3. In the embodiment shown, the spindle nut 16 is connected via a grub screw 19 to a turning knob 22.

In the embodiment shown in FIG. 4, the spindle nut 16 is connected by means of a featherkey 23 to a shaft 24 of a geared motor 25, which is flanged to a bracket 18 attached to the side wall 3.

Automatic matching of the inclination of the suction-type grippers to the curvature of the trailing-edge region of the pile of sheets is accomplished, in accordance with an embodiment of the invention shown diagrammatically in FIG. 5, by means of a scanning device 26. The scanning device 26 has two sensors 27 and 28, with which it scans the edge of the pile at two measuring locations 29 and 30 on the pile 31, the measuring locations being located behind one another in the sheet travel direction, and supplies a control signal dependent upon the difference in height 32 between the measuring locations. The control signal activates the geared motor 25, with the spindle nut 16 connected thereto, so that the suction-type grippers become so inclined that they are disposed virtually perpendicularly on the connecting line between the two measuring locations 29 and 30.

A scanning device with contactless sensors is particularly suitable for automatically adjusting the inclination of the suction-type grippers during the operation of the printing press.

Such a scanning device 26′ is shown diagrammatically in FIG. 6. The contactless sensors 27′ and 28′ may, for example, be in the form of reflected-light sensors or dynamic-pressure jets and are disposed opposite a side face 35 of the pile of sheets, where they do not impede the lifting-off of the uppermost sheet. Just like the sensors 27 and 28 in FIG. 5, the sensors 27′ and 28′ are spaced apart in the sheet travel direction by a mutual spacing 34 corresponding to the distance between the measuring locations 29 and 30.

The scanning device 26, 26′ can be moved in vertical direction by means of an adjusting device which is not shown in the drawing. By rigidly arranging on the two sensors 27, 27′ in the scanning device 26, 26′, it is possible to set the sensors 27, 27′ to a working height 36. With respect to the scanning device 26 according to FIG. 5, the working height 36 is reached as soon as the sensor 27 is located on the surface of the sheet pile 31 at the measuring location 29. With respect to the scanning device 26′ according to FIG. 6, the working height 36 is selected so that at the measuring location 29, the sensor 27′ is located directly below the surface of the sheet pile 31. Furthermore, the scanning device 26, 26′ is provided with adjusting means described hereinbelow by means of which at least one sensor 28, 28′ can be automatically adjusted vertically with respect to the other sensor 27, 27′. The sensor 28, 28′, for example, is rigidly disposed in the scanning device 26, 26′, in such a manner that it is situated at the measuring location 30 subject to a height difference 32 in relation to the sensor 27, 27′, which is also rigidly disposed in the scanning device 26. In the case of contactless sensors, the sensor 28′ is likewise disposed directly below the surface of the pile of sheets 31, e.g., like the sensor 27′, it is in a position in which, if the sensors 27′, 28′ are formed as reflected-light sensors, the sensor 28′ is just covered by the pile of sheets.

If the scanning device 26, 26′ is equipped with one rigid sensor 27, 27′, and one sensor 28, 28′ which is vertically adjustable with respect to the forms, the aforementioned adjusting means are required only for one sensor.

If each of the two sensors is equipped with adjusting means, it is possible for both sensors to adapt automatically to the respective height of the pile of sheets at the respective measuring location.

In order to adapt to different formats or sizes of sheets making up the pile, it is advisable that the adjusting device (not shown in the drawing) for moving the scanning device 26, 26′ in the vertical direction be also able to move the scanning device 26, 26′ in the horizontal direction.

Examples of the aforementioned adjusting means for the sensors 27, 27′, 28, 28′ are shown in circuit diagrams in FIGS. 5*a* and 6*a*.

FIG. 5*a*, as mentioned hereinabove, is a diagrammatic view of a scanning device 26 according to FIG. 5 in which inductive distance indicators available on the market are used as sensors 27 and 28. In this case, the aforementioned adjusting means are formed as respective adjusting springs 37 such as compression springs and are clamped between a respective adjusting ring 38 located on a measuring rod 39 and a measuring-rod housing 40 being rigidly disposed in a fragmentarily shown housing 41 of the scanning device 26.

Via signal lines 127 and 128, the sensors 27 and 28 are connected to a comparator 42. A difference signal, which is available at the output of the comparator 42 and corresponds to the difference in height 32 (note FIG. 5), is supplied to a first input and a reference signal to a second input of a further comparator 43 at the output of which the adjusting signal for activating the gear motor 25 is available.

In this case, the reference signal is obtained from a potentiometer 44 adjustable by the geared motor 25 and from a further potentiometer 61 by means of which it is possible to assign to a given difference in height 32, a specific position of the sliding contact of the potentiometer 44 and thereby a specific swivel position of the link 11 due to a respective rotary position of the spindle nut 16 which is adjustable by means of the geared motor 25.

As mentioned hereinabove, FIG. 6a is a diagrammatic and schematic view of a scanning device 26' according to FIG. 6, the scanning device 26' activating a geared motor 25 with a spindle nut connected to the latter according to FIG. 4 so as to be rigid against relative rotation. In this embodiment, reflected-light probes are used as sensors 27' and 28'. Each of the sensors 27' and 28' has a first flexible light guide 227 and 228, respectively, the upper end of which is illuminated by means of a light source 129 and 130, respectively, and a second flexible light guide 327 and 328, respectively, the upper end of which is located opposite a respective photodiode 131, 132. In each sensor housing 427 and 428, respectively, a respective pair of light guides 227, 327; 228, 328 are aligned so that, depending upon the respective height thereof, they are located either opposite a side face of the sheet pile 31 or above the sheet pile 31.

With the aid of further aforementioned adjusting means, the respective height level can be adjusted. For this purpose, the respective sensor housing 427, 428 is vertically guided with respect to a housing (not illustrated in FIG. 6a) of the scanning device 26' by means of non-illustrated guides and provided with a toothed rack 45, 46 which, for adjusting the height levels of the sensors 27', 28' cooperates with a respective gearwheel 47, 48 which, in turn, can be driven by means of a respective reversible servomotor 49, 50.

The respective servomotor 49, 50 is activated by a respective comparator 51, 52, one input of which is connected to a respective photodiode 131,132. The respective other input of the comparator 51, 52 is connected to a respective variable resistor 53, 54 by means of which a reference voltage can be set. The respective servomotor 49, 50 rotates in a first direction so that the respective sensor 27', 28' is lowered when the lower ends of the light guides pairs 227, 327: 228, 328 project above the sheet pile 31 and, in opposite direction, when these lower ends are located opposite the afore-mentioned side face of the sheet pile 31. Between the lower ends of the two light guide pairs 227, 327; 228, 328, a height difference 32 corresponding to the curvature of the sheet pile 31 (note FIG. 6) is automatically set.

A difference signal corresponding to the height difference 32 is obtained from a further comparator 57, each input of which is connected to a respective further potentiometer 55, 56 which, in turn, is adjustable by means of one of the servomotors 49 and 50.

The geared motor 25 is finally activated by means of a further comparator 58, one input of which is connected to the output of the comparator 57, and the other input of which has a reference signal applied thereto. The reference signal is obtained from a further potentiometer 59 which is adjustable by means of the geared motor 25, and from a further potentiometer 60 which can be set so that the respective swivel position of the link 11, resulting from a specific rotary position of the spindle nut 16, which is adjustable by means of the geared motor 25 (note also FIG. 4), is adapted to a specific height difference 32.

Based upon FIG. 5a, the aforementioned modification of a scanning device having a rigid sensor and a sensor vertically adjustable with respect to the rigid sensor is constructed, for example, so that, instead of the sensor in the form of an inductive distance indicator, there is provided a scanning pin which is placed upon the surface of the sheet pile 31 by means of the aforementioned non-illustrated adjusting device for the scanning device 26. In this case, it is unnecessary to generate a difference signal by means of the comparator 42, and one input of the comparator 43 can be connected to the comparator 42, and one input of the comparator 43 can be connected to the signal line 128.

The embodiment shown in FIGS. 1 and 2 employs a lifting gear drive with which the carrying shaft is not raised and lowered on an ideally straight path. Within the scope of the invention, however, it is also possible to use a lifting gear drive with which even minor deviations from a straight path can be prevented and, thus, with which the transport of the sheets can be made even safer.

Starting from the lifting gear drive shown in FIG. 2, it would be possible, for this purpose, to provide a second guide roller disposed at a distance from the existing guide roller, as viewed in the longitudinal direction of the lifting rod 10, and for the lever 33, supported on the cam plate 32, to be provided with a slot the point of its articulation with the lifting rod.

We claim:

1. Suction-type sheet-separating device for a feeder of a printing press with suction-type grippers for lifting off an uppermost sheet from a pile of sheets and for transferring the lifted-off sheet to transporting means for conveying the lifted-off sheet in a sheet travel direction towards a printing unit of the printing press, the suction-type grippers being disposed above the pile of sheets in the vicinity of a trailing edge of each sheet and when having suction air applied thereto initially gripping an uppermost sheet and then executing a prestroke to a first height, comprising a lifting gear drive and a horizontal carrying shaft parallel to the trailing edge of the sheet and carrying the suction-type grippers, the suction-type grippers being aligned with respect to said carrying shaft, said lifting gear drive serving, on an upward stroke and a downward stroke in phase with the printing press, to raise and lower, respectively, said carrying shaft on a substantially straight, vertical path in a manner that, on an upward stroke, the suction-type grippers are raised to a second height located above the first height, means for holding the carrying shaft in the lifting gear drive so that it is able to swivel about its own longitudinal axis and is rotationally rigidly connected, so as to be rigid against relative rotation, to a link for a swivelling device for selective swivel positions, and means for guiding said link substantially parallel to itself in the selectable swivel positions.

2. Suction-type sheet-separating device according to claim 1, wherein said swivelling device is formed of said link, a vertical first straight guide for one end of said link facing away from said carrying shaft, a second straight guide for the first straight guide disposed parallel to the sheet-travel direction, and adjusting means by which said first straight guide is displaceable on said second straight guide both in and opposite to the sheet travel direction.

3. Suction-type sheet-separating device according to claim 2, wherein said vertical first straight guide is formed with two spaced-apart guide surfaces perpendicular to the sheet travel direction and a roller guided between said guide surfaces, said roller being held on the one end of said link facing away from said carrying shaft so that it is freely rotatable about a roller shaft disposed parallel to said carrying shaft carrying said roller.

4. Suction-type sheet-separating device according to claim 2, wherein said adjusting means comprise an adjusting spindle articulatingly connected to said first straight guide, and an axially clamped spindle nut cooperating with said adjusting spindle.

5. Suction-type sheet-separating device according to claim 3, wherein said spindle nut is connected to a turning knob so as to be fixed against relative rotation therewith.

6. Suction-type sheet-separating device according to claim 3, including automatic reversible driving means, said spindle nut being rotationally connected to said automatic reversible driving means.

7. Suction-type sheet-separating device according to claim 6, including manually operated switching means for selecting a direction of rotation and a rotational speed of said spindle nut, said reversible driving means being connected to said switching means.

8. Suction-type sheet-separating device according to claim 6, including a scanning device having at least one first sensor and at least one second sensor for scanning a curved surface of a border region of the pile of sheets associated with the trailing sheet edge, at least at one first and one second measuring location, said measuring locations being disposed behind one another in the sheet travel direction, said reversible driving means being activatable by said scanning device as a function of a difference in height between said first and said second measuring location.

9. Suction-type sheet-separating device according to claim 8, wherein said sensors are contactless sensors.

10. Suction-type sheet-separating device according to claim 9, wherein said contactless sensors are located opposite a side face of the pile of sheets, said side face being formed of edges of the sheets forming the pile of sheets and extending in the sheet travel direction.

11. Suction-type sheet-separating device according to claim 8 wherein, measured in the sheet travel direction, said first sensor and said second sensor are disposed at a spaced distance from one another, said distance being the distance between said measuring locations, at least one of said sensors being vertically adjustable with respect to the other sensor.

12. Suction-type sheet-separating device according to claim 8, wherein one of said sensors is rigidly disposed in said scanning device and is adjustable to a selective working height by means of an adjusting device for said scanning device.

13. Suction-type sheet-separating device according to claim 8, wherein said first sensor and said second sensor are each vertically adjustable with respect to one another.

14. Suction-type sheet-separating device according to claim 8, wherein said scanning device is horizontally movable.

15. Suction-type sheet-separating device according to claim 1, wherein said lifting gear drive is constructed for guiding said carrying shaft on a straight path at least during said upward stroke thereof.

* * * * *